US010487504B1

(12) United States Patent
Nickerson et al.

(10) Patent No.: US 10,487,504 B1
(45) Date of Patent: Nov. 26, 2019

(54) STRUCTURAL BLOCK ASSEMBLY

(71) Applicant: Concrete Block Insulating Systems, Inc., West Brookfield, MA (US)

(72) Inventors: David L. Nickerson, Wilbraham, MA (US); Jeffrey A. Nickerson, North Brookfield, MA (US); Paul W. Grycel, Sarasota, FL (US)

(73) Assignee: Concrete Block Insulating Systems, Inc., West Brookfield, MA (US)

( * ) Notice: Subject to any disclaimer, the term of this patent is extended or adjusted under 35 U.S.C. 154(b) by 0 days.

(21) Appl. No.: 15/918,186

(22) Filed: Mar. 12, 2018

Related U.S. Application Data

(60) Provisional application No. 62/469,568, filed on Mar. 10, 2017.

(51) Int. Cl.
*E04C 1/41* (2006.01)
*E04B 2/14* (2006.01)
*E04B 2/02* (2006.01)

(52) U.S. Cl.
CPC ..... *E04C 1/41* (2013.01); *E04B 2/14* (2013.01); *E04B 2002/0289* (2013.01); *E04B 2002/0293* (2013.01)

(58) Field of Classification Search
CPC ..... E04C 1/39; E04C 1/40; E04C 1/41; E04B 2/14; E04B 2002/0289; E04B 2002/0293
See application file for complete search history.

(56) References Cited

U.S. PATENT DOCUMENTS 2,737,801 A * 3/1956 Barnhart ..... E04B 2/02 425/DIG. 109
4,380,887 A * 4/1983 Lee ..... B28B 7/162 52/405.1
4,543,229 A * 9/1985 Nickerson ..... E04C 1/41 264/321
5,822,939 A * 10/1998 Haener ..... E04C 1/41 52/405.2
6,134,853 A * 10/2000 Haener ..... E04C 1/41 52/405.2
8,091,308 B2 * 1/2012 Westmoreland ..... E04B 2/52 52/309.12
2006/0093440 A1 * 5/2006 Shaw ..... E02D 29/025 405/286
2006/0156656 A1 * 7/2006 Robinson ..... E04B 2/16 52/220.2

* cited by examiner

*Primary Examiner* — Andrew J Triggs
(74) *Attorney, Agent, or Firm* — Doherty, Wallace, Pillsbury & Murphy, P.C.

(57) ABSTRACT

A structural block assembly for providing insulation to a structure comprising a structural block and an insulation insert. The structural block includes a body having oppositely situated forward and rearward members, oppositely situated proximal and distal members, and a chamber formed between the forward and rearward members and the proximal and distal members. A web, which is positioned within the chamber, centrally extends from the rearward member towards the forward member, wherein a gap is formed between the web and the forward member. The insulation insert is disposed between the web and the forward member, thereby dividing the chamber into a proximal-oriented compartment and a distal-oriented compartment. The web also has a slot formed therethough, wherein the slot assists in maximizing an R-value for the completed wall constructed with the block.

14 Claims, 7 Drawing Sheets

10
12
21
28
56
20
29
22
14
14
14

STRUCTURAL BLOCK ASSEMBLY

BACKGROUND TO THE INVENTION

1. Field of the Invention

The present invention relates to structural blocks such as those commonly referred to as "concrete blocks" used for constructing both load bearing and non-load bearing walls of buildings.

2. Background of the Invention

Structural blocks are usually formed with two or three vertical holes formed therein and are constructed of concrete comprised of at least one of cinders, sand, gravel, and other types of aggregates. Less commonly, the blocks may be constructed of fired brick or clay tile. The holes in the blocks provide a substantial decrease in weight and material without a commensurate decrease in structural strength. The holes also provide some insulating value as closed airspace in a completed wall.

There are projects for which a 24-inch concrete block is advisable. However, to date, 24-inch concrete blocks have not been considered for thermal characteristics. Accordingly, commercially available 24-inch blocks are not designed with insulating and thermal conductivity considerations in mind. Rather, insulation is provided for either exteriorly or interiorly of the wall, with insulation in the latter instance normally being in the form of the pouring type which inherently presents moisture problems. Additionally, if insulation is applied over the inside face of the block wall, this adds considerably to the material and labor expense, and presents problems in terms of appearance.

SUMMARY OF THE INVENTION

An object of the structural block assemblies disclosed herein is to provide a structural block especially designed to achieve maximum insulating properties while at the same time achieving a desired balance in the thermal conduction transverse to the block, without detracting from the load carrying properties of the block. Therefore, provided for herein is a structural block, and most preferably, a 24"×8"×12" structural block, having a high-density insulation material having a density of about 1.3-1.8 lbs/ft$^3$ installed on a forward member of the structural block, wherein, when installed as part of a wall of a building, the forward member is directed towards the outside facing wall of the building. The insulation material allows the structural block to meet maximum R-values (insulated units must exhibit a specified minimum insulation R-value, which relates to a measure of thermal resistance (i.e., resistance to heat flow) in a given thickness of material. Generally, the R-value is the ratio of the temperature difference across an insulator and the heat flux. The higher the R-value, the more effective the insulation is at resisting heat flow). Additionally, the structural block conforms to National Concrete Masonry Association ("NCMA") standards. When the structural block is cut in half, the structural block is half-way insulated. Additionally, the structural block is designed to be open so that vertical steel and concrete grout can go through the structural block.

The structural block assembly includes a structural block that includes a body having oppositely situated forward and rearward members, oppositely situated proximal and distal members, and a chamber formed between the forward and rearward members and the proximal and distal members. A web, which is positioned within the chamber, centrally extends from the rearward member towards the forward member such that a gap is created between the web and the forward member. The web also has a slot formed therethough, wherein the slot assists in maximizing an R-value for the block.

The assembly further comprises an insulation insert that is disposed between the web and the forward member, thereby dividing the chamber into a proximal-oriented compartment and a distal-oriented compartment. When used for building purposes, the forward member is installed towards an outside-oriented wall.

These and various other advantages and features of novelty which characterize the invention are pointed out with particularity in the claims annexed hereto and forming a part hereof. However, for a better understanding of the invention, its advantages, and objects obtained by its use, reference should be had to the accompanying drawings and descriptive matter, in which there is illustrated and described preferred embodiments of the invention.

BRIEF DESCRIPTION OF THE DRAWINGS

For a better understanding of these and other objects of the present invention, reference will be made to the detailed description of the present invention which is to be read in association with the accompanying drawings, wherein:

FIG. 6 is a schematic depicting the insulation insert depicted in FIGS. 4 and 5.

DETAILED DESCRIPTION OF THE INVENTION

Figure 1:
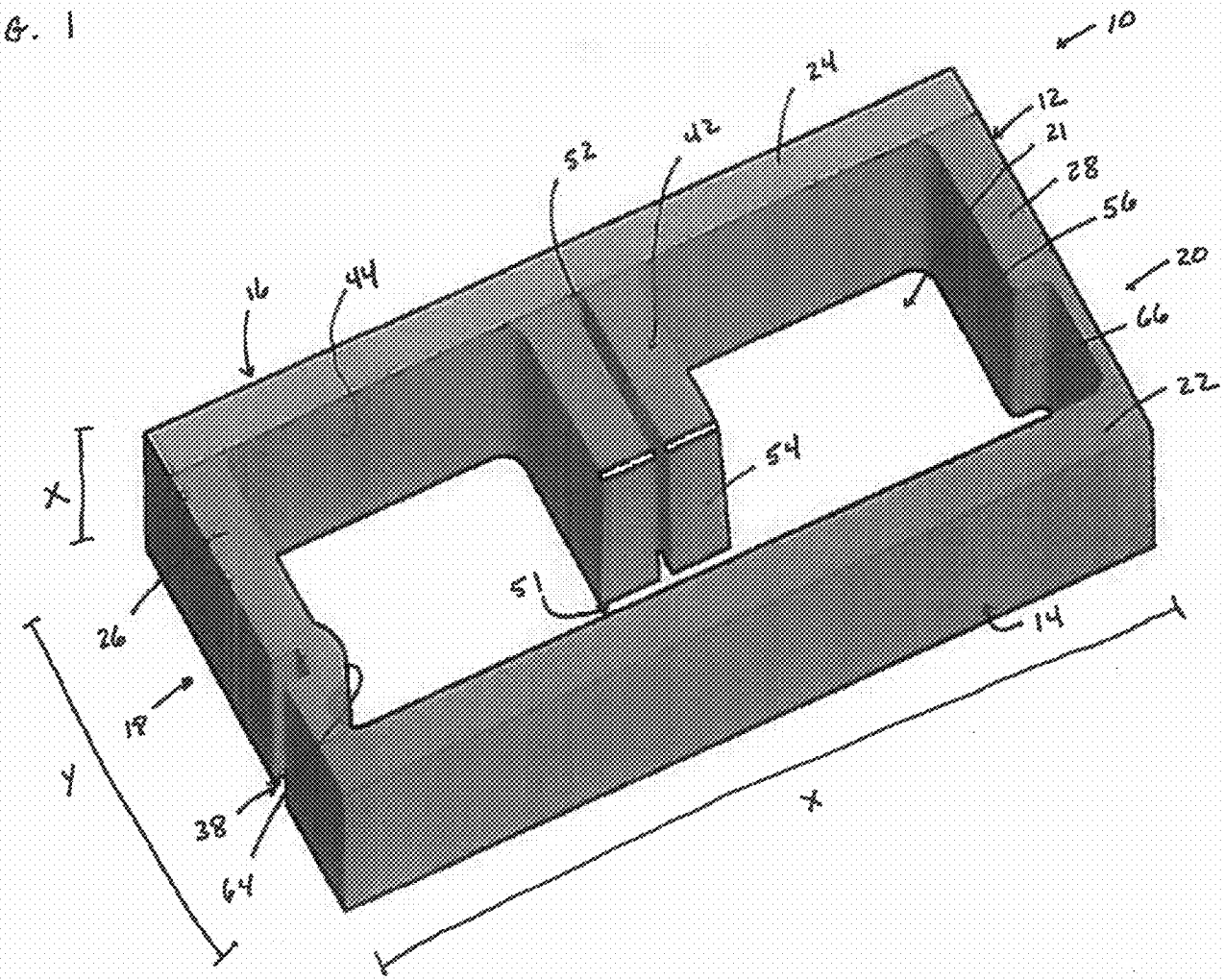
FIG. 1 is a schematic depicting a perspective top side view of an exemplary structural block, wherein a forward member of the structural block is facing forward.

For purposes of the description hereinafter, the terms "top," "bottom," "forward," "rearward", "proximal", "distal," "interior", "exterior," and derivatives thereof shall relate to the invention as it is oriented in the drawing figures. However, it is to be understood that the invention may assume various alternative variations, except where expressly specified to the contrary. It is also to be understood that the specific elements, members, and components, illustrated in the attached drawings, and described in the following specification, are simply exemplary embodiments of the invention. Hence, specific dimensions and other physical characteristics related to the embodiments disclosed herein are not to be considered as limiting unless expressly stated otherwise.

The present invention is directed to a structural block and assembly, as illustrated in various preferred and non-limiting embodiments in FIGS. 1-7. As discussed hereinafter, the structural blocks and assemblies can be used in connection with and embody a variety of structural units, but has particular application in connection with concrete masonry units (CMUs). Accordingly, while discussed hereinafter primarily in connection with such CMUs, the structural blocks and assemblies described herein equally can be useful in connection with other types of structural or modular units for use in constructing and installing buildings, foundations, walls, load-bearing structures, and the like.

In general, the structural block assembly comprises a structural block having a generally rectangular shaped body having a forward member oppositely situated to a rearward member, and a proximal member oppositely situated to a distal member. The structural block further comprises a web having a generally rectangular shaped body comprising a top side oppositely situated to a bottom side, wherein the top and bottom sides of the web are centrally and contiguously formed with and extend from the rearward member, and wherein the body of the web terminates at a forward leading wall that is contiguously formed with the top and bottom sides of the web and that is oriented and extends towards the forward member. A chamber is surrounded by the forward member, the rearward member, the proximal member, and the web. The structural block assembly further comprises an insulation insert. In a preferred embodiment, the insulation insert has a density of about 1.3 pounds per cubic foot to about 1.8 pounds per cubic foot. The insulation insert may be disposed within the chamber such that the insulation insert physically abuts the forward member, the proximal member, the distal member, and the forward leading wall of the web such that a discrete proximal chamber is wholly formed between the insulation insert, the rearward member, the proximal member and the web and a discrete distal chamber is wholly formed between the insulation insert, the rearward member, the distal member, and the web.

Figure 2:
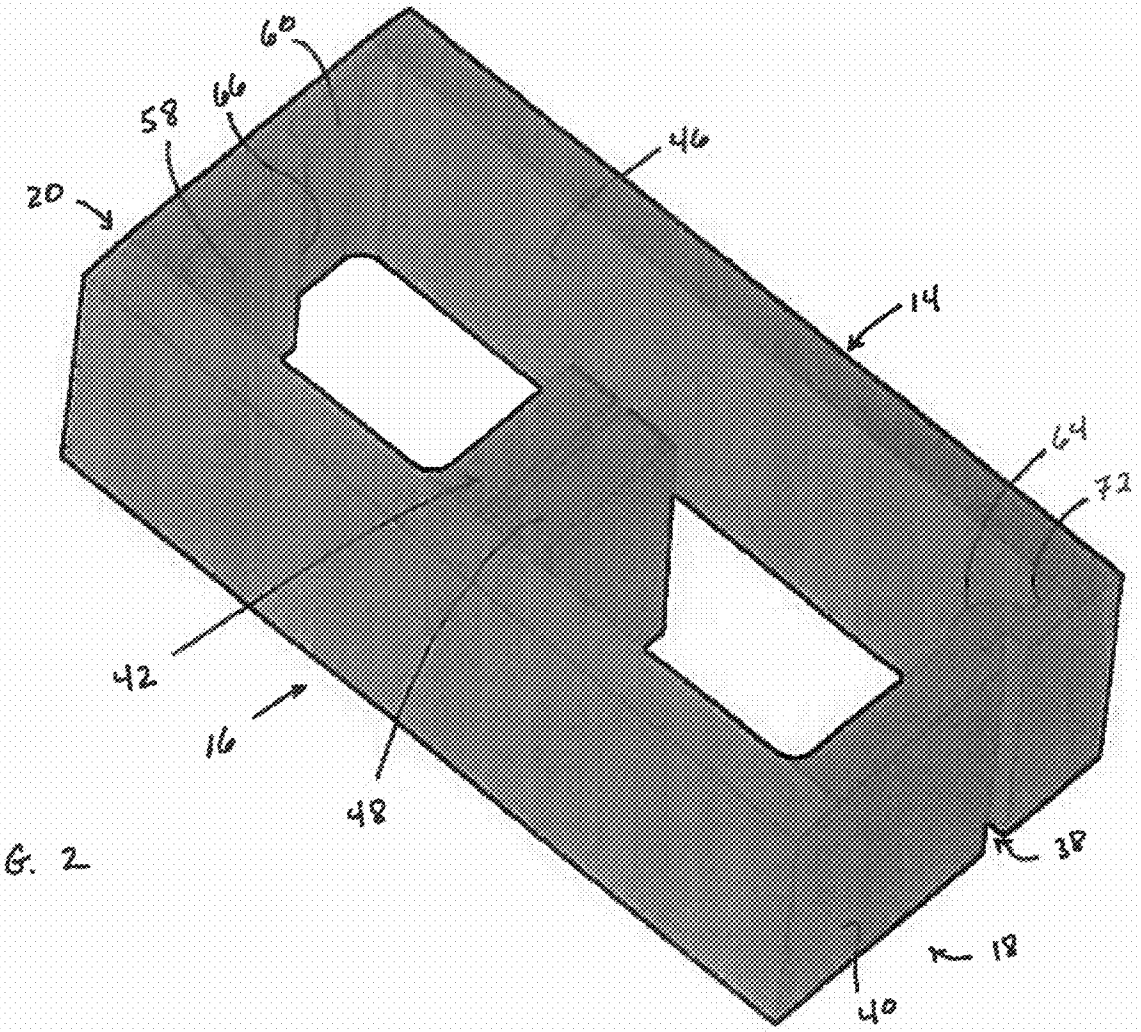
FIG. 2 is a schematic depicting a perspective top side view of the structural block depicted in FIG. 1, wherein a rearward member of the structural block is facing forward.
Figure 3:
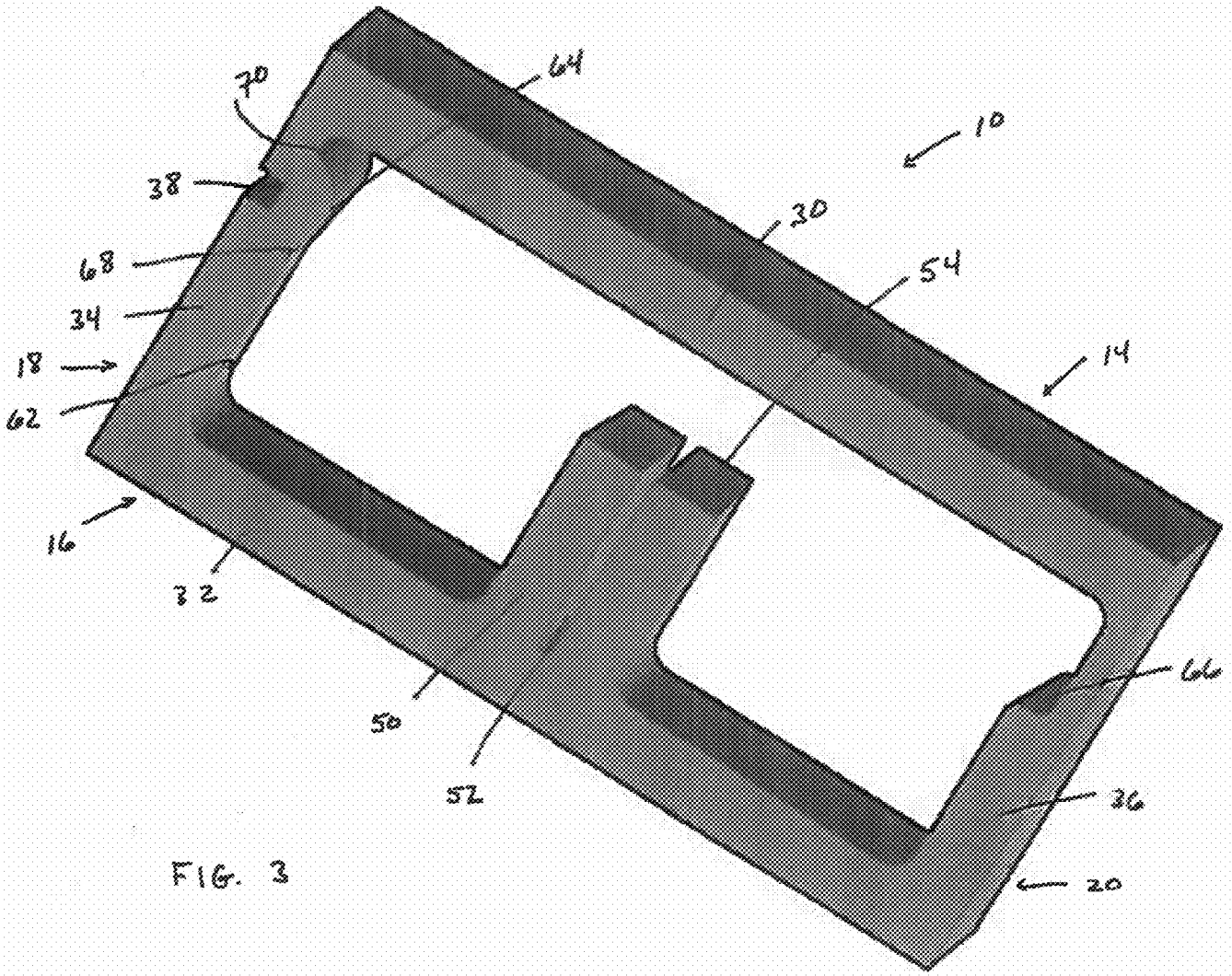
FIG. 3 is a schematic depicting a perspective bottom side view of the structural block depicted in FIG. 1.

In one preferred and non-limiting embodiment illustrated in FIGS. 1-3, provided is a structural block 10. In this embodiment, structural block 10 includes a generally rectangular shaped body 12 having a forward member 14 oppositely situated to a rearward member 16, and a proximal member 18 oppositely situated to a distal member 20, wherein forward, rearward, proximal and distal members 14, 16, 18, and 20 surround a chamber 21. In a preferred embodiment, forward and rearward members 14 and 16 have a length X of about 24 inches, and a maximum height Z of about 12 inches, and proximal and distal members 18 and 20 have a length Y of about 12 inches. The block configuration of 12-inches wide, 8-inches high, and 24-inches long is ideal because it allows the mason to construct a wall faster with fewer individual blocks, and to compete with the prefabricated construction materials which are installed presently.

A top side 22 of forward face 14 is contiguously formed with top sides 26 and 28 of respective proximal and distal members 18 and 20 and is recessed relative thereto, while a top side 24 of rearward member 16 is contiguously formed with top sides 26 and 28 of respective proximal and distal members 18 and 20 and is raised relative thereto. Bottom sides 30, 32, 34, and 36 of respective forward member 14, rearward member 16, proximal member 18, and distal member 20 are coplanar with one another.

A longitudinally extending groove 38 is continuously formed through top side 24, an exterior side 40 of proximal member 18, and bottom side 34 of proximal member 18. Groove 38 preferably is a sash groove used as a sealing spacer for a rubber control joint gasket to seal windows and doors.

Structural block 10 further comprises a web 42 which is centrally and contiguously formed with an interior side 44 of rearward member 16 and longitudinally extends into chamber 21 and towards an interior side 46 of forward member 14 wherein a gap 51 is created between a forward leading wall 54 of web 42 and interior side 46 of forward member 14. A top side 48 of web 42 is recessed relative to top side 24 of rearward member 16, while a bottom side 50 of web 42 is coplanar with bottom side 32 of rearward member 16.

A longitudinally extending opening 52 is formed through web 42. Opening 52 continuously extends from top side 48 to bottom side 50 of web 42 and through forward leading wall 54 of web 42, thereby essentially dividing web 42 into two equal subparts. Opening 52 is in fluid communication with chamber 21.

An interior side 56 of distal member 20 of structural block 10 is divided into a rearward directed interior wall 58 and a forward directed interior wall 60, wherein rearward directed interior wall 58 is contiguously formed with interior side 44 of rearward member 16 and forward directed interior wall 60 is contiguously formed with interior side 46 of forward member 14. Forward directed interior wall 60 is recessed relative to rearward directed interior wall 58, thereby exposing a buttress wall 66 which longitudinally extends from top side 28 to bottom side 36 of distal member 20 and which divides forward directed region 60 from rearward directed region 58.

An interior side 62 of proximal member 18 comprises a longitudinally extending substantially convex shaped wall 64 that is contiguously formed with and continuously extends from top side 26 and bottom side 34 of proximal member 18, and which overlies groove 38. Convex shaped wall 64 has a rearward directed edge 68 and a forward directed to edge 70, wherein forward directed edge 70 is non-planar with rearward directed edge 68. Rearward directed edge 68, buttress wall 66 of distal member 20, and forward leading wall 54 of web 42 are coplanar with one another.

Forward directed edge 70 turns inwardly to form a longitudinally extending generally concave-shaped wall 72 which is contiguously formed with top and bottom sides 26 and 34 of proximal member 18 and with top and bottom sides 22 and 30 of forward member 14.

Figure 4:
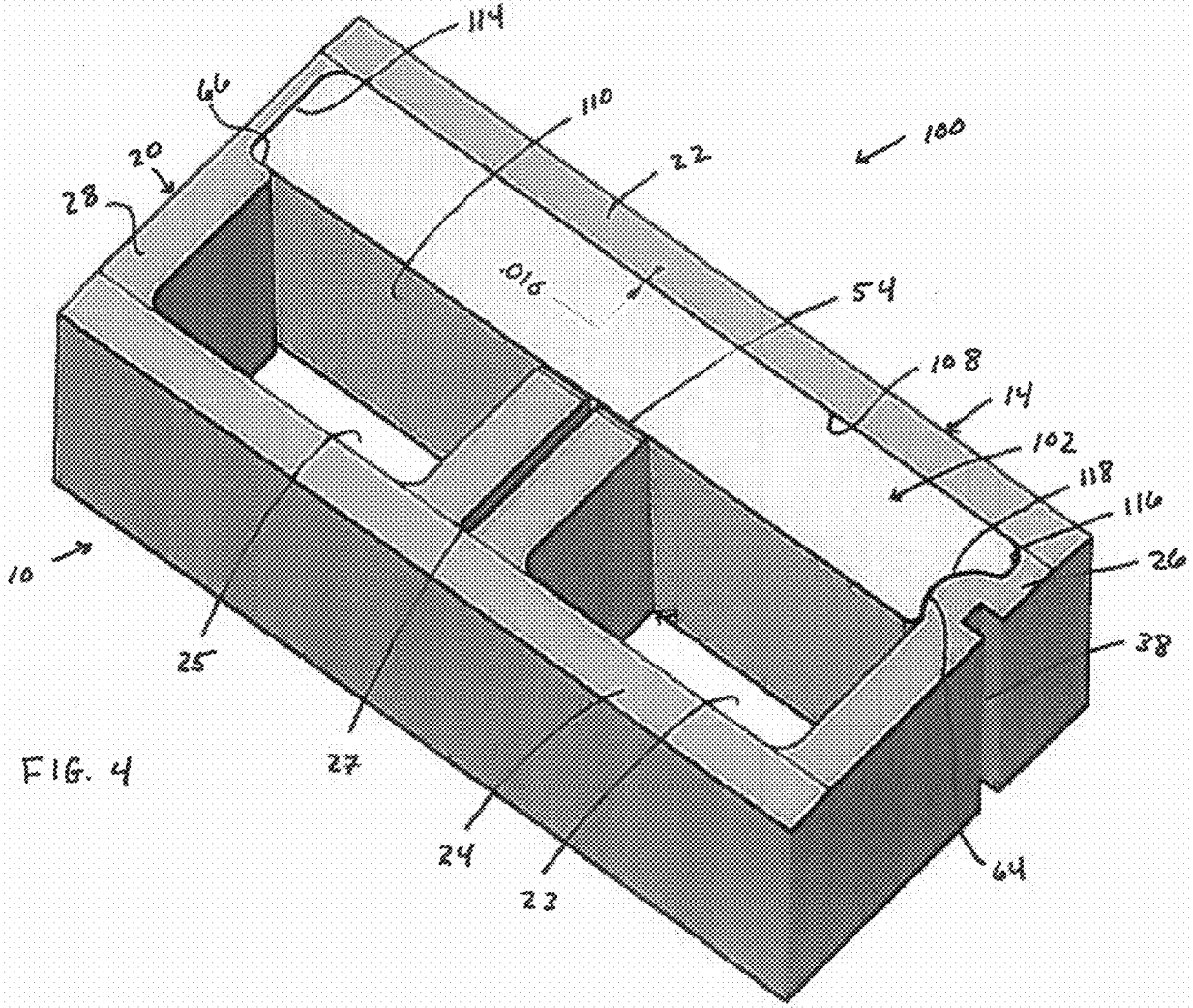
FIGS. 4 and 5 are schematics depicting an exemplary structural block assembly comprising the structural block depicted in FIG. 1 and an exemplary insulation insert.
Figure 5:
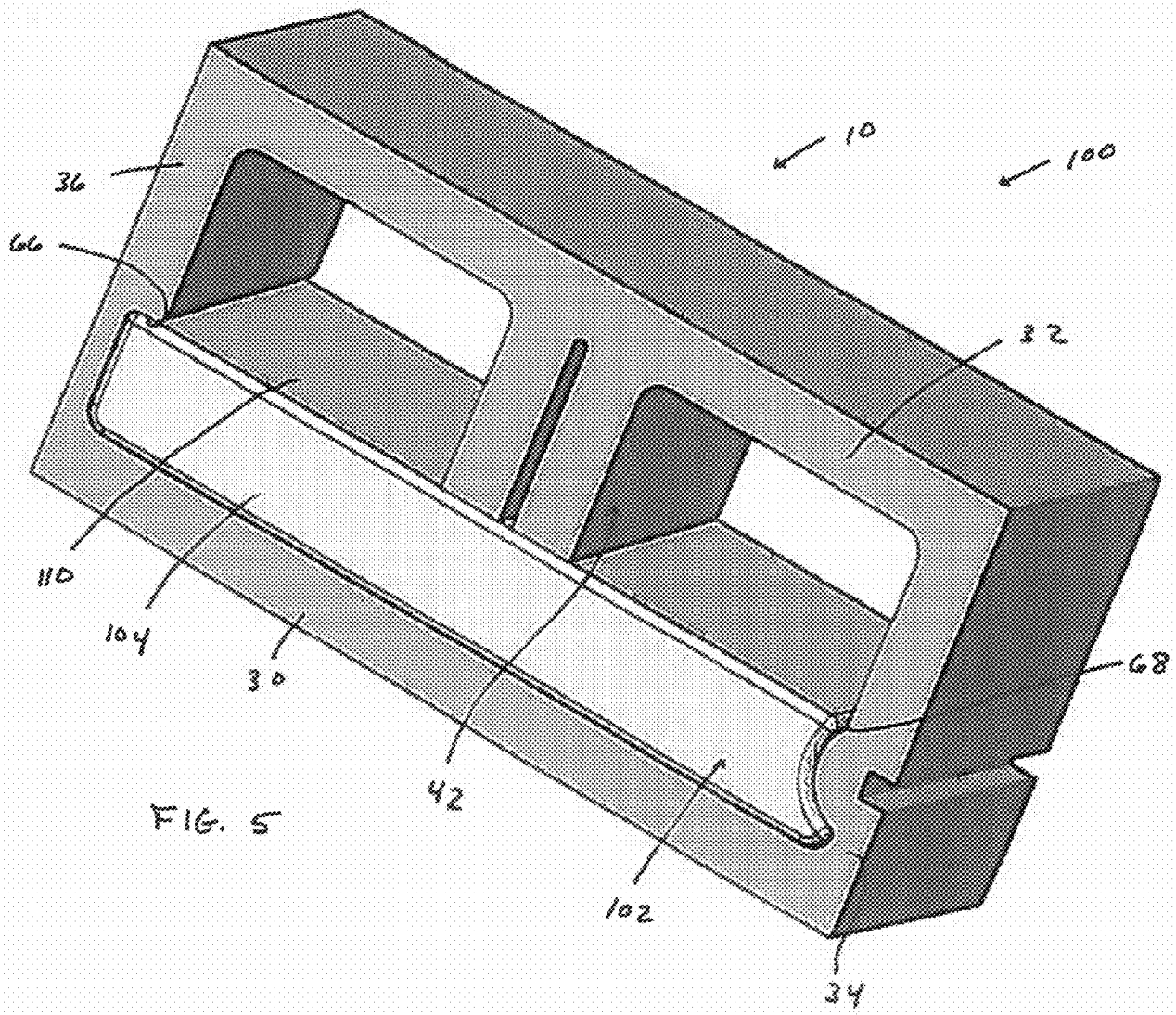

Referring to FIGS. 4 and 5, an exemplary assembly 100 comprises structural block 10 and an insulation insert 102. Referring to FIG. 6, insulation insert 102 comprises a top side 104 oppositely situated to a bottom side 106, a forward face 108 oppositely situated to a rearward face 110, and a proximal side 112 oppositely situated to a distal side 114. Proximal side 112 has a generally concave-shaped longitudinally extending wall 118 which is contiguously formed with top and bottom sides 104 and 106 and with rearward face 110, and which is further immediately adjacent to and contiguously formed with a generally convex-shaped longitudinally extending wall 116, wherein wall 116 overhangs wall 118 and is contiguously formed with top and bottom sides 104 and 106 and with forward face 108.

Insulation insert 102 may be made of conventional expandable polystyrene foam and of modified polystyrene foam such as NOVA or BASF Neopor@ foams, which are expandable polystyrene foams which may be formulated with graphite in the cell structure. Insulation insert 102 may be formed of additional or alternative foams, including, for example, polyurethane foam, isoprene foam, and the like.

Insulation layer 102 may have a forward to rearward thickness that is dependent upon the size of the block and upon the degree of desired heat insulation, wherein a thickness of up to at least about 1 inch is preferred. Additionally, the thickness of insulation insert 102 can be adjusted to achieve a desired R value for a particular foam material or to match desired dimensions of the structure within which the block system is to be used. In an especially preferred embodiment, insulation insert 102 comprises a high-density insulation material having a density of about 1.3-1.8 lbs/ft$^3$.

As shown in FIGS. 4 and 5, insulation insert 102 is disposed within chamber 21 such that forward face 108 physically abuts interior side 46 of forward member 14, rearward face 110 physically abuts buttress wall 66 of distal member 20 and forward leading wall 54 of web 42, distal side 114 physically abuts interior side forward directed interior wall 60 of distal member 20, concave-shaped wall 118 physically abuts convex-shaped wall 64, and convex-shaped wall 116 physically abuts concave-shaped wall 72. Once so positioned, insulation insert 102 divides chamber 21 into a hollow proximal-oriented compartment 23, a hollow distal-oriented compartment 25, and a hollow medial compartment 27.

Figure 7:
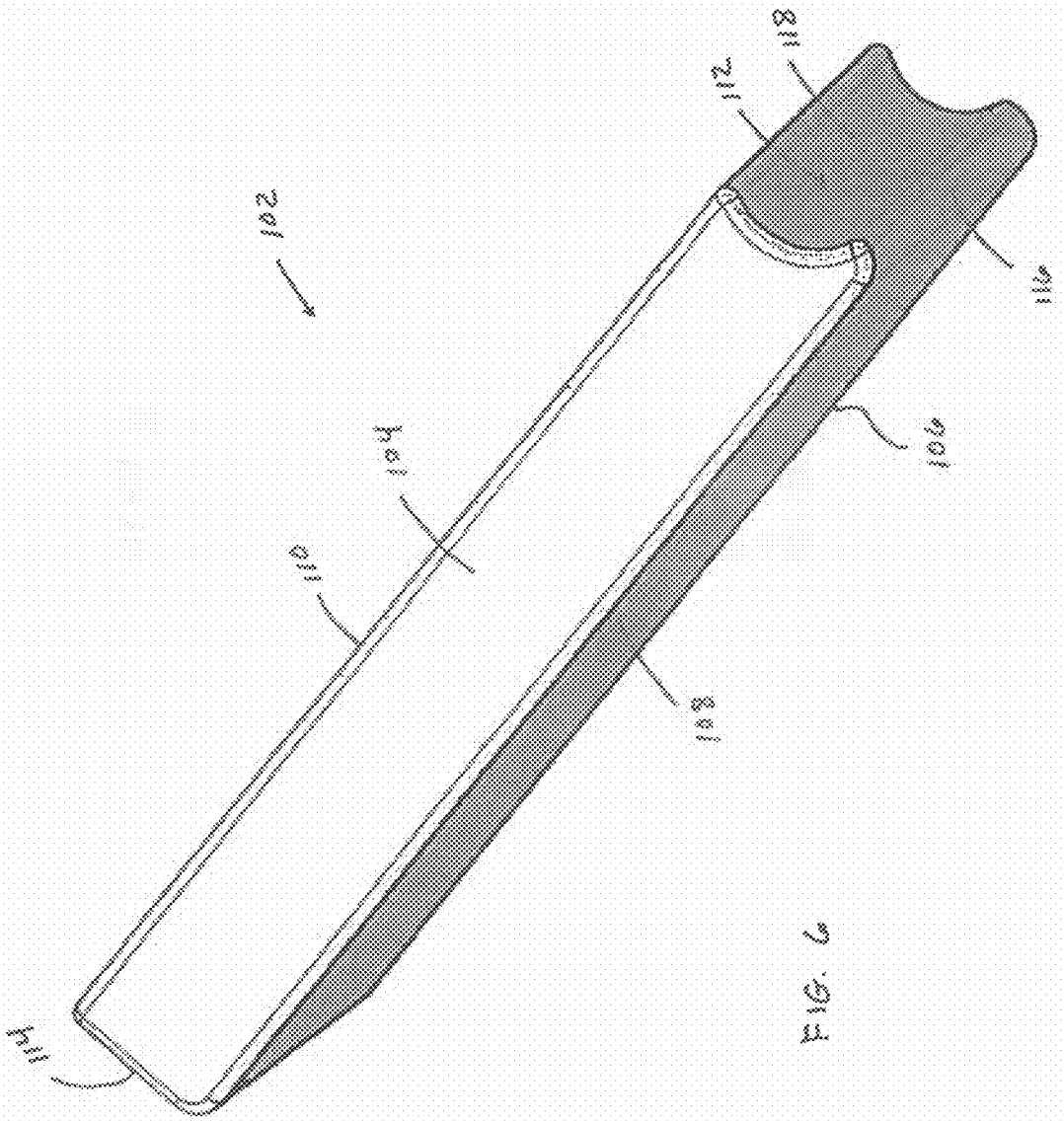
FIG. 7 is a schematic depicting a perspective top side view of another exemplary structural block.
Figure 7:
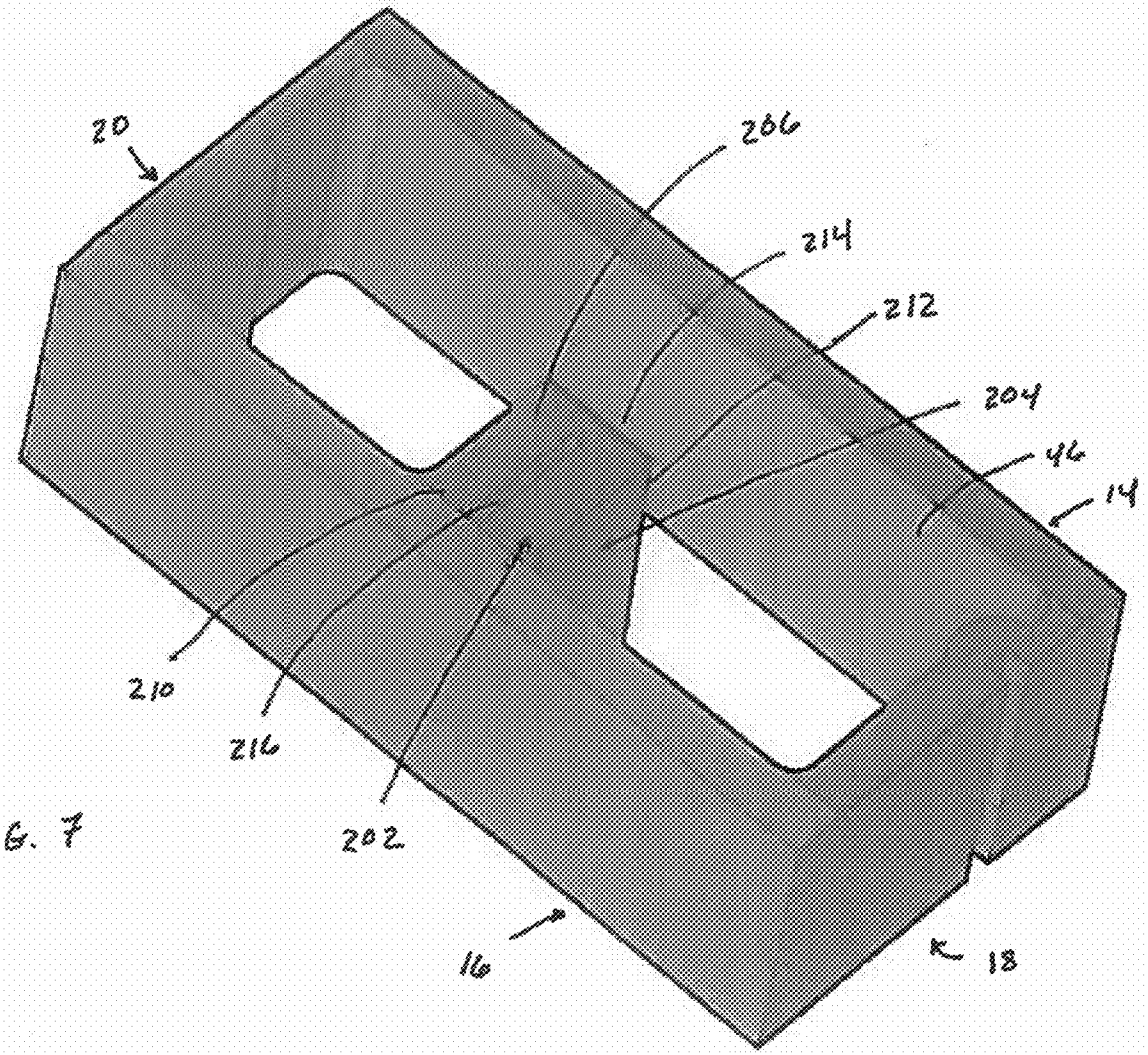

Another exemplary structural block is shown in FIG. 7. Here, a structural block 200 is essentially identical to structural block 100 except that block 200 has a web 202 in lieu of web 42. Web 202 comprises a generally columnar shaped body 204. Body 204 comprises a top wall 206 oppositely situated to a bottom wall (not shown), and a rearward directed wall 210 oppositely situated to a forward directed wall 212. Rearward directed wall 210 is contiguously formed with interior side 44 of rearward member and extends therefrom such that forward directed wall 212 is directed towards interior side 46 of forward member 14, wherein a gap 214 is created between forward directed wall 212 and interior side 46. A continuously extending slot 216 is formed through rearward directed wall 210 and through top and bottom walls 206 and 208 and falls short of extending through forward directed wall 212 such that slot 216 is not in fluid communication with chamber 21.

Although not shown, insulation insert 102 may be fitted within structural block 200 in an identical fashion as described above with references to FIGS. 4 and 5.

As appreciated by one of ordinary skill in the art, the structural blocks and assemblies disclosed herein provide an effective insulation layer for structures built using CMUs. The concrete blocks and the assemblies disclosed herein provide an effective means for meeting NCMA standards while also allowing the assemblies to meet maximum R-values.

The inventive block has less web as compared to conventionally used blocks, which allows the insert to take the place of the web in the block. The insert increases the R value of the wall and meets code requirements for strength. The insert supports the long side of the block so that it is less likely to fracture. The insert makes the block more sturdy and less likely to break and creates an R value of insulation for the wall. The 24-inch block is likely to fracture because the length is unsupported and fragile. With the insert, it is supported. A steel core, if required, may still be installed through the block alongside the insulation insert in the proximal or distal oriented compartments. The inventive block renders the wall more thermally efficient, meets code requirements, and allows masons laying block to compete with pre-fabricated construction since the blocks are longer, and the mason can complete the wall in less time. The insulation insert allows the block to meet or exceed ASTM code requirements.

CMUs having dimensions of 12-inches wide×8-inches high×24-inches long, 8-inches wide×8-inches high×24-inches long, or 6-inches wide×8-inches high×24-inches long are becoming more common in the construction industry, since the mason in the field has been using 16-inch blocks and the mason can lay a longer block and compete with pre-cast concrete as well as "tilt-up" or steel stud construction. This assists the mason to compete in the field with pre-fabricated materials.

Although the invention has been described in detail for the purpose of illustration based on what are currently considered to be practical and preferred embodiments, it is to be understood that such detail is solely for that purpose and that the invention is not limited to the disclosed embodiments, but, on the contrary, is intended to cover modifications and equivalent arrangements that are within the spirit and scope hereof. For example, it is to be understood that the present invention contemplates that, to the extent possible, one or more features of any embodiment can be combined with one or more features of any other embodiment.

What is claimed is:

1. A structural block assembly, comprising:

a structural block, comprising:

a generally rectangular shaped-body comprising a forward member oppositely situated to a rearward member, and a proximal member oppositely situated to a distal member, wherein each of the forward, rearward, proximal, and distal members respectively comprises a top side oppositely situated to a bottom side, and an exterior side oppositely situated to an interior side, wherein the interior and exterior sides are formed with the respective top and bottom sides, and wherein the body further comprises a chamber defined and surrounded by the interior sides, the top sides, and the bottom sides of the forward, rearward, proximal and distal members; and a web comprising a substantially rectangular shaved body which is contiguously formed with the interior side of the rearward member and which is centrally disposed within the chamber, wherein the body of the web is defined by a top side oppositely situated to a bottom side and a proximal side oppositely situated to a distal side, wherein the proximal side is directed towards the proximal member and the distal side is directed towards the distal member, and further wherein the top side of the web has a rearward terminal edge that is continuously formed with an interior-directed edge of the top side of the rearward member and slopes away at an acute angle therefrom until it levels off to form a substantially planar top surface that is substantially parallel to the top sides of the proximal and distal members of the body of the block, wherein the substantially planar top surface is recessed relative to the top side of the rearward member, and wherein the substantially planar top surface extends towards the forward member and turns substantially perpendicularly towards the bottom sides of the forward and rearward members to form a substantially planar forward leading wall, which extends to and is contiguously formed with the bottom side of the web, wherein the bottom side of the web is contiguously formed with and coplanar with the bottom side of the rearward member, and wherein a gap is formed between the forward leading wall of the web and the interior side of the forward member; and an insulation insert disposed within the chamber of the structural block such that a forward face of the insert physically abuts the interior side of the forward member of the block, a rearward face of the insert physically abuts the forward leading wall of the web, a distal side of the insert physically abuts the distal member of the block, and a proximal side of the insert physically abuts the proximal member of the block, thereby creating a discrete hollow proximal oriented compartment and a discrete hollow distal oriented compartment, wherein the discrete hollow proximal oriented compartment is wholly defined by the rearward face of the insulation insert, by the proximal and rearward members, and by the web, and wherein the hollow distal oriented compartment is wholly defined by the rearward face of the insulation insert, by the distal and rearward members, and by the web.

2. The structural block assembly of claim 1, wherein the body of the web further comprises a slot surrounded and enclosed by the forward leading wall, the proximal side of the web, the distal side of the web, and the interior side of the rearward member of the body of the block, and further wherein the slot is centrally formed through the body of the web and longitudinally extends from the top and bottom sides of the web to form a first opening on the top side of the web and a second opening on the bottom side of the web.

3. The structural block assembly of claim 1, wherein the body of the web further comprises a slot centrally formed through the body of the web, wherein the slot extends from the top and bottom sides of the web to form a first opening through the top side of the web, a second opening through the bottom side of the web, and a third opening through the forward leading wall thereby dividing the web into two subparts.

4. The structural block assembly of claim 3, wherein the forward and rearward members of the block have a length of about 24 inches, and the proximal and distal members of the block have a length of about 12 inches.

5. The structural block assembly of claim 3, wherein the top side of the rearward member is raised relative to the top sides of the forward, proximal and distal members, and wherein the top sides of the web and of the proximal and distal members are coplanar.

6. The structural block assembly of claim 3, wherein the interior side of the distal member turns substantially perpendicularly towards the exterior side of the distal member to form a buttress wall which extends from and is contiguously formed with the top and bottom sides of the distal member, and wherein the buttress wall turns substantially perpendicularly towards the interior side of the forward member to form a forward directed interior wall which extends from and is contiguously formed with the top and bottom sides of the distal member.

7. The structural block assembly of claim 6, wherein the forward directed interior wall of the distal member is integrally formed with the forward member.

8. The structural block assembly of claim 7, wherein the interior side of the proximal member has a generally convex shaped wall integrally formed thereon, wherein the generally convex shaped wall is aligned with and oriented towards the forward directed interior wall of the distal member, and further wherein the generally convex shaped wall is contiguously formed with and continuously extends from the top and bottom sides of the proximal member.

9. The structural block assembly of claim 8, wherein the block further comprises a longitudinally extending groove, wherein the groove is formed through the top, exterior, and bottom sides of the proximal member, and further wherein the generally convex shaped wall of the structural block centrally overlies the groove.

10. The structural block assembly of claim 9, wherein the generally convex shaped wall terminates at a rearward directed edge and at an oppositely situated forward directed edge, wherein the rearward directed edge is oriented towards the rearward member and the forward directed edge is oriented towards the forward member, and further wherein the rearward directed edge is coplanar with the buttress wall of the distal member and with the forward leading wall of the web and further wherein the forward directed edge turns towards the exterior side of the proximal member to form a longitudinally extending substantially concave-shaped wall that is contiguously formed with the top and bottom sides of the proximal member and with the top and bottom sides of the forward member.

11. The structural block assembly of claim 9, wherein the proximal side of the insert has a generally concave-shaped longitudinally extending wall which is contiguously formed with the top and bottom sides of the insert and with the rearward face of the insert, and which is further immediately adjacent to and contiguously formed with a generally convex-shaped longitudinally extending wall, wherein the generally convex shaped wall of the insert overhangs the generally concave-shaped longitudinally extending wall of the insert and is contiguously formed with the top and bottom sides and of the insert and with the forward face of the insert, wherein the insulation insert is disposed within the chamber of the block such that the forward face of the insert physically abuts the interior side of the forward member of the block, the rearward face of the insert physically abuts the buttress wall of the distal member of the block and the forward leading wall of the web, the distal side of the insert physically abuts the forward directed interior wall of the distal member, and the generally concave-shaped wall of the insert physically abuts the generally convex-shaped wall of the block.

12. The structural block assembly of claim 11, wherein the forward and rearward members of the structural block have a length of about 24 inches, and the proximal and distal members of the structural block have a length of about 12 inches.

13. The structural block assembly of claim 12, wherein the insulation insert comprises a density of about 1.3 pounds per cubic foot to about 1.8 pounds per cubic foot.

14. The structural block assembly of claim 13, wherein the insulation insert comprises at least one of polystyrene foam, polyurethane foam, and isoprene foam.

* * * * *